United States Patent [19]

Esper et al.

[11] 4,320,080

[45] Mar. 16, 1982

[54] METHOD TO MANUFACTURE SOFT MAGNETIC PRESSED BODIES

[75] Inventors: Friedrich Esper, Leonberg; Hans-Martin Wiedenmann, Stuttgart, both of Fed. Rep. of Germany

[73] Assignee: Robert Bosch GmbH, Stuttgart, Fed. Rep. of Germany

[21] Appl. No.: 193,467

[22] Filed: Oct. 3, 1980

Related U.S. Application Data

[63] Continuation-in-part of Ser. No. 163,730, Jun. 27, 1980, abandoned, which is a continuation of Ser. No. 22,282, Mar. 20, 1979, abandoned.

[30] Foreign Application Priority Data

Mar. 22, 1978 [DE] Fed. Rep. of Germany ..... 2812445

[51] Int. Cl.[3] ..... B22F 3/02

[52] U.S. Cl. ..... 264/111; 252/62.54; 264/86; 264/331.21; 264/DIG. 58; 264/331.22

[58] Field of Search ..... 252/62.54; 264/331, 264/DIG. 58, 111, 86

[56] References Cited

U.S. PATENT DOCUMENTS

| | | | |
|---|---|---|---|
| 2,503,947 | 4/1950 | Haskew | 252/62.54 |
| 2,508,705 | 5/1950 | Beller et al. | 252/62.54 |
| 2,964,793 | 12/1960 | Blume | 252/62.54 |
| 3,126,617 | 3/1964 | Blume | 252/62.54 |

FOREIGN PATENT DOCUMENTS

| | | | |
|---|---|---|---|
| 226097 | 12/1959 | Australia | 252/62.54 |
| 998853 | 7/1965 | United Kingdom | 252/62.54 |

*Primary Examiner*—James H. Derrington

*Attorney, Agent, or Firm*—Frishauf, Holtz, Goodman & Woodward

[57] ABSTRACT

To permit use of less expensive iron powder material and manufacture of more complex shapes, a mixture of iron powder, of an approximate grain size of between 30 to 450 μm, and containing preferably 5 to 50% of carbonyl iron powder or from 5 to 50%, by weight, of soft ferrite powder of a grain size of from 10 to 200 μm, and a thermosetting resin, in which the thermosetting resin is about 50% by volume of the overall mixture, is filled into a die. Pressure is built up in the die, which is heated, permitting excess binder to escape during the build-up phase thereof, the pressure then being held so that the resin can set in the heated die. The pressures needed are substantially less than heretofore required, in the order of from between 500 to 5000 bar.

16 Claims, No Drawings

METHOD TO MANUFACTURE SOFT MAGNETIC PRESSED BODIES

This is a continuation-in-part application of application Ser. No. 163,730, filed June 27, 1980 (now abandoned), which, in turn, was a continuation of application Ser. No. 22,282, filed Mar. 20, 1979 (now abandoned).

The present invention relates to a method to manufacture shaped bodies having soft magnetic properties by press-forming a mixture of soft magnetic material and a resin, forming a binder.

BACKGROUND AND PRIOR ART

It has previously been proposed to manufacture core structures of soft magnetic properties which contain from between 95 to 99.5% carbonyl iron, and the rest an organic binder (by weight). Carbonyl iron is comparatively expensive so that magnets made from this material are also comparatively expensive. Additionally, since the filler or active component is a very high proportion of the overall mass, the structure is difficult to manufacture since it does not flow readily. Especially complex shapes, therefore, are difficult to make since the mass will not flow easily and uniformly in the die therefore. The mass must be compacted with extremely high pressures, in the order of from between 5000 to 18000 bar. The mechanical strength of the structures made by this mass is low, and the articles are brittle. Further, it is difficult to match the magnetic properties of cores made from such compacted masses to desired technical requirements.

It has also been proposed to make magnetic cores of soft magnetic sintered ferrites. These materials have a lower magnetic saturation polarization, a lower mechanical strength, and a higher dependence on temperature of the magnetic characteristics thereof. The possibility of providing different structural shapes to magnets of this type are very limited, and the tolerances of their dimensions are high. They are difficult to be machined after sintering.

Cores have also been made of transformer iron or transformer laminar sheets. Laminated cores can be used only up to frequencies of about 1 kHz due to eddy current losses. The structural shapes which can be obtained by such cores also are limited, and the cores have to be stacked and connected together, which is a comparatively expensive manufacturing operation. Some sheets which have a thickness of only 0.03 mm or less, and made of nickel-iron alloys, can be used for frequencies up to 100 kHz and have higher permeabilities; these sheets, however, are difficult to handle, to machine, and are expensive.

THE INVENTION

It is an object to provide a method to make soft magnetic materials and, consequently, such materials which can be easily shaped to desired configurations, use materials which are less expensive than those heretofore employed, and which are versatile.

Briefly, a mixture of soft magnetic material and resin binder is provided in which the soft magnetic material is an iron powder i.e. an atomized, a sponge or an electrolytic iron powder, in the following called "normal iron powder", in most cases mixed together with iron powder produced from iron carbonyl, the magnetic material then being mixed with a thermosetting resin in liquid form. The mixture is filled into a die. The die is heated and pressure applied, the build-up of the pressure in the die permitting escape of excess liquid of the resin through the clearance between the die walls and the pressing punches during build-up of the pressure, and before setting thereof.

The method permits use of a percentage of carbonyl iron powder, up to 50% by weight, for example, or a replacement of the carbonyl iron by soft ferrite powder. The particle size of the normal iron powder is preferably from 30 to 450 μm, the particle size of the carbonyl iron powder is mainly less than 10 μm; if soft ferrite powder is used, a particle size from 10 to 200 μm can be used. As thermosetting resin preferably a polyester resin or a phenol resin is used in a proportion (by volume) of 20% to 60% resin, preferably about 50%. The pressure which is required can be substantially less than heretofore thought necessary, that is, from between 200 to 5000 bar.

The clearance between the die walls and the punches should be less than 0,1 mm. The iron powder compacted to a certain amount in front of the gap between the die walls and the punches acts like a filter thus letting through practically only the liquid resin.

Pressure is built up during a limited time, for example from 1 to 30 seconds. Maximum compacting pressure has to be retained until the resin is set. The total compacting time is dependent upon the size of the compact and differs between 1 minute and 10 minutes essentially.

The resulting cores are inexpensive in comparison to previously made magnets, can be used especially advantageously in magnetic circuits with an air gap of alternate magnetization in frequencies up to 100 kHz, and can be shaped as desired. The mass which is compacted is flowable initially, and it is thus an easy matter to form complex structures accurately to size by using methods which are customary in plastic casting and plastic molding technology. The pressure of between 200 to 5000 bar is comparatively low with respect to the pressure needed to make cores in accordance with prior art processes. The starting material can readily be varied by changing the relative composition of the filler material; by varying this composition and varying the pressure, the magnetic characteristics of the resulting structure can be easily matched to desired technical requirements. The cores which are formed by this method have a higher magnetic saturation polarization than sintered ferrites, are mechanically stronger, and are less subject to change in their magnetic properties with change in temperature.

The shape of the compacts can be more intricate than heretofore thought possible, since the original mass is fairly easily flowable, and thus can penetrate small pockets in the die. After compression, the cores will have a size which in most cases can be accurately maintained, because the tolerances being maintainable will be low. If necessary, the resulting material can easily be readily machined.

Cores made in accordance with the above method are excellent for use in magnetic circuits with d-c bias magnetization; because of their higher magnetic saturation polarization they are more advantageous than sintered soft ferrites. Cores made by this method can be used to replace cores previously made of transformer sheets or other electrical steel sheets, and are particularly suitable for operation in higher frequence ranges. The possibility to make such cores in complex shapes extends the applicability thereof and provides the electromagnetic circuit designer with a more versatile material.

Eddy current losses can be reduced by using, in accordance with a feature of the invention, a high percentage of soft ferrite powder rather than powder made from iron carbonyl, or to entirely replace the carbonyl iron portion of the mass with soft ferrite powder. Even materials without additions of neither carbonyl iron nor soft ferrite powder have lower eddy current losses in magnet circuits up to rather high frequencies than soft magnetic sheet metals.

DETAILED DESCRIPTION

Example 1

A mixture of iron powder composed of 70 wt% of normal iron powder with a medium grain size of about 90 μm and 30 wt% of carbonyl iron powder with a maximum grain size less than 10 μm is mixed with about 50 by volume of a liquid polyester resin. It is then introduced into a die which has been heated to about 100° C. The mixture is compacted with a pressure of about 1000 bar, for 40 seconds. The clearance between the die walls and the punches must be wide enough that excess binder resin can escape from the die during the build-up time of the compacting pressure, which will extend of from between 1 to 30 seconds. The excess polyester resin thus is squeezed out from the final material to be made and permitted to escape through the gap. The squeezing-out of excess binder material is essential since, otherwise, the high degree of filler, that is, of magnetic material, cannot be obtained while, also, having sufficient flowability of the material when it is introduced into the die and during the first stage of the compacting step.

The thermo-set soft magnetic body can be removed from the form after cooling.

The overall time for the manufacture of any one body, therefore, depends upon the size of the compacted body—as mentioned above.

The finished article will habe a composition which includes about 12% binder (by weight).

In a preferred form, the polyester resin is: Palatal A410 (BASF).

Example 2

A mixture of normal iron powder, and 10% carbonyl iron powder (by weight) is mixed with about 50% by volume of phenol resin, subject to a compacting pressure of, finally, 2000 bar, the die being heated to 140° C. A suitable phenol is: Novolak.

Example 3

It is not necessary to use carbonyl iron powder at all. Screend normal iron powder is mixed with 50% (by volume) of polyester resin. The die is heated to a temperature of about 100° C. The compacting pressure is 500 bar.

The table shows properties of the materials made in accordance with the methods and provides comparative data with respect to known articles.

The temperatures to which the dies are heated will depend on the chemical characteristics of the particular resin used, and can readily be determined by consulting tables derived from the manufacturers of the respective resins which give the thermosetting temperature thereof, and also the time periods required to effect setting of the thermosetting resin. The temperature should not be so high that, upon filling, the mass will set quickly, to permit squeezing-out of excess resin during pressure build-up.

Suitable polyester resins are molding components with sufficient mechanical strength and temperature stability.

Suitable phenol resins are: Novolak and Resolstype.

The percentage of addition of carbonyl iron powder to the iron powder normally used in P/M technique will determine the eventual frequency response characteristics of the material without excessive losses—the Q thereof—and the eventual costs, since a higher degree of carbonyl iron powder will result in more costly core materials while, on the other hand, permitting operation at higher frequency ranges. The specific quantity of addition of carbonyl iron powder—up to 50% being about suitable—will depend on the eventual use of the resulting material.

The resin binder used for the method to manufacture the soft magnetic pressed bodies has a viscosity not less than 1 pascal.sec (1000 cpoise). The reasons for this are that the magnetic particles cannot be suspended for a long enough period and that the binding agent, i.e. the resin cannot be distributed in a sufficiently complete and uniform manner necessary for completely and uniformly surrounding the magnetic particles. This however is a basic requirement for obtaining a high electrical resistance for lowering the magnetical losses of the magnets produced by the claimed method, and for obtaining a sufficient mechanical strength.

Also for these reasons the resin should not be dissolved in a solvent or thinner because those solutions have a too low viscosity.

TABLE 1

Comparison of various soft magnetic materials
(A) Measured values from static magnetization curves
(B) Measurements taken on transformer cores E42; coil 100 turns; resistance 0.18; air core inductance 147 μ H; quality $Q_o$ = 4.7 at 1 kHz
= 1.8 at 10 kHz

| | | (A) | | | | (B) | | | |
|---|---|---|---|---|---|---|---|---|---|
| | | | | | | $L/L_o$ | | quality Q | |
| | Density g/cm³ | spec. elec. resistance Ωcm | magnetic saturation polarization Tesla | coercivity A/cm | permeability | 1 kHz | 10 kHz | 1 kHz | 10 kHz |
| mixture of normal iron and 30% carbonyl iron powder in polyester; compracting pressure 1000 bar | 6.0 | $\sim 10^{-1}$ | 1.3 | 6.0 ‖ | 130 ‖ | 9.6 | 9.6 | 31 | 2.5 |
| mixture of normal iron | | | | | | | | | |

TABLE 1-continued

Comparison of various soft magnetic materials
(A) Measured values from static magnetization curves
(B) Measurements taken on transformer cores E42; coil 100 turns; resistance 0.18; air core inductance 147 μ H; quality $Q_o$ = 4.7 at 1 kHz
= 1.8 at 10 kHz

| | (A) | | | | | (B) | | | |
|---|---|---|---|---|---|---|---|---|---|
| | | | | | | $L/L_o$ | | quality Q | |
| | Density g/cm³ | spec. elec. resistance Ωcm | magnetic saturation polarization Tesla | coercivity A/cm | permeability | 1 kHz | 10 kHz | 1 kHz | 10 kHz |
| and 10% carbonyl iron powder in phenol resin; compacting pressure 2000 bar | 6.4 | $\sim 2.10^{-3}$ | 1.5 | 4.8 ‖ | 270 ‖ | — | — | — | — |
| screened normal iron powder in polyester; compacting pressure 500 bar | 4.9 | ~10 | 1.07 | 3.4 ‖;1.3⊥ | 146 ‖;300⊥ | — | — | — | — |
| core laminate; 0.5 mm | 7.8 | $4.10^{-5}$ | 2.0 | 0.5 | ~2000 | 46 | 15 | 4.5 | 0.1 |
| sintered ferrite air gap s = 0 | 4.8 | $10^2$ | 0.43 | 0.3 | ~2000 | 170 | 175 | 30 | 21 |
| s = 2 mm | — | — | — | — | — | 11.3 | 11.3 | 30 | 6.3 |
| core of carbonyl iron | 5.18 | $\sim 10^2$ | 1.1 | 8.0 | 12.0 | — | — | — | — |

We claim:

1. Method to manufacture soft magnetic pressed bodies comprising a mixture of soft magnetic material and a resin binder, comprising the steps of preparing a mixture of iron powder which includes atomized, sponge or electrolytic iron powder and a liquid component consisting essentially of a liquid thermosetting resin having a viscosity of at least 1,000 cpoises;

filling the mixture into a die;

heating said die;

building up pressure in said die to squeeze out excess liquid and permit escape thereof through the clearance between die walls and adjacent punch side walls during build-up of the pressure;

and keeping the pressure for final compacting until the resin has cured.

2. Method according to claim 1, wherein the mixture is filled into a heated die, and is then compacted.

3. Method according to claim 1, wherein the iron powder further includes carbonyl iron powder.

4. Method according to claim 3, wherein the carbonyl iron powder is present in an amount up to 50%, by weight, of the iron powder.

5. Method according to claim 1, wherein the carbonyl iron powder at least partially is replaced by soft ferrite powder.

6. Method according to claim 5, wherein the soft ferrite powder is present in a quantity of from 5 to 50% by weight of the iron powder mixture.

7. Method according to claim 1, wherein the iron powder has a grain size of from about 30 to 450 micrometers.

8. Method according to claim 5, wherein the soft ferrite powder has a grain size of between 10 to 200 micrometers.

9. Method according to claim 1, wherein the thermosetting resin comprises at least one resin selected from the group consisting of polyester resin and phenol resin.

10. Method according to claim 1, wherein the step of building up pressure in the die comprises applying a pressure of between 200 to 5000 bar.

11. Method according to claim 1, wherein the step of buildig up pressure comprises building up the pressure during a period of from 1 to 30 seconds; and then holding the pressure during the time required for the thermosetting resin to completely set.

12. Method according to claim 1, wherein the step of mixing the iron powder with the thermosetting resin comprises mixing the iron powder with liquid thermosetting resin in a proportion (by volume) of 20% to 60% resin.

13. Method according to any one of claims 1, 4, 6, 7, 8, 9, 10 or 11, wherein the step of mixing the iron powder with the thermosetting resin comprises mixing the iron powder with liquid thermosetting resin in a proportion (by volume) of about 50%.

14. Method of manufacturing soft magnetic pressed bodies comprising a mixture of soft magnetic materials and a resin binder, comprising the steps of:

admixing iron powder having a grain size of from about 30 to 450 micrometers and a liquid component consisting essentially of a liquid thermosetting resin having a viscosity of at least 1,000 cpoises;

filling said mixture into a die;

heating said die; applying a pressure in the die of between 200 and 5,000 bar during a period of from one to thirty seconds to squeeze out excess liquid and permit escape thereof through the clearance between the die walls and punch side walls during build-up of the pressure, and maintaining the pressure until said resin has cured.

15. Method according to claim 14 wherein said thermosetting resin is selected from a group consisting of polyester and phenol resins and wherein said liquid thermosetting resin is in a proportion (by volume) of about 50% of the mixture of iron powders and liquid thermosetting resins.

16. Method according to claim 14 or 15 wherein from 5 to 50% of said carbonyl iron powder is replaced by soft ferrite powder having a grain size of between 10 and 20 micro-meters.

* * * * *